US006894212B2

(12) United States Patent
Capano

(10) Patent No.: US 6,894,212 B2
(45) Date of Patent: May 17, 2005

(54) WRIST MUSICAL INSTRUMENT TUNER

(76) Inventor: David Capano, 501 Locust Grove Rd., Greenfield Center, NY (US) 12833

( * ) Notice: Subject to any disclaimer, the term of this patent is extended or adjusted under 35 U.S.C. 154(b) by 17 days.

(21) Appl. No.: 10/348,683

(22) Filed: Jan. 22, 2003

(65) Prior Publication Data

US 2004/0139841 A1 Jul. 22, 2004

(51) Int. Cl.[7] ..... G10G 7/02
(52) U.S. Cl. ..... 84/454; 84/477 R; 84/600
(58) Field of Search ..... 84/600–602, 453–454, 84/470 R, 477 R

(56) References Cited

U.S. PATENT DOCUMENTS 5,016,515 A * 5/1991 Scott ..... 84/454
5,105,711 A * 4/1992 Barnard ..... 84/744
5,388,496 A * 2/1995 Miller et al. ..... 84/454
5,768,127 A * 6/1998 Murata ..... 84/602
5,777,248 A * 7/1998 Campbell ..... 84/454
5,831,190 A * 11/1998 Trabucco, Jr. ..... 84/477 R
6,242,682 B1 * 6/2001 Marinic et al. ..... 84/626
6,529,843 B1 * 3/2003 Carpenter ..... 84/454

* cited by examiner

*Primary Examiner*—Marlon Fletcher

(57) ABSTRACT

A wrist mounted electronic tuning device for use in tuning an acoustic musical instrument which includes a self-adapting wristband to automatically accommodate to a wide range of wrist sizes. Additionally, the tuning device includes sensing means operable for sensing an acoustic musical tone produced by the musical instrument and producing a representative electrical signal, conditioning means operable for amplifying, pre-filtering, and shaping the electrical signal into a representative pulse train, input means for selecting a musical note to tune to, computing means for receiving the pulse train and selected musical note and utilizing pre-programmed algorithms to determine the instrument's tuning condition, an output means to annunciate the tuning condition, and a power level switching means to permit the tuner to function in either a fully powered signal acquisition state or low power sleep state.

9 Claims, 3 Drawing Sheets

WRIST MUSICAL INSTRUMENT TUNER

BACKGROUND OF THE INVENTION

1. Field of the Invention

This invention relates to a new and improved tuning device for use in tuning a musical instrument. More particularly, this invention embodies features which permit it to tune a class of acoustic musical instruments, such as acoustic guitars, in an exceptionally convenient manner.

2. Description of the Prior Art

Described in the prior art are many devices intended to facilitate the tuning of acoustic musical instruments. They include the pioneering tuner disclosed in Krauss, U.S. Pat. No. 2,806,953, in which a stroboscopic disc, spinning at a precisely controlled reference rate of rotation, is illuminated by a neon lamp which is caused to flash at the frequency of an unknown musical tone. A stationary pattern, indicating an in-tune condition, is observed when the frequency of the unknown tone is equal to the rotational frequency of the disc. If the tone is flat, the pattern will appear to rotate in a first direction at a rate proportional to the amount of deviation of the tone from the reference rate. If the tone is sharp, the pattern will appear to rotate in the opposite direction. Despite the bulk and weight of this early vacuum tube driven electromechanical device, as well as the need to power it from 120 VAC, it became a tuning standard for many years.

With the emergence of microelectronics, and especially the availability of the single chip microprocessor/microcontroller, more recent tuning devices have appeared which enable the tuning of acoustic instruments with enhanced portability and utility. An example is the electronic tuning device of Miller, et al., U.S. Pat. No. 5,388,496. This device includes a row of twelve light emitting diodes (LEDs) which correspond to the twelve musical semitones, tone sensing circuitry which is optimized to receive a musical tone through a double back adhesive rubber pad and provide a representative electrical signal, and a single chip programmed microprocessor which operates to determine the fundamental frequency of the electrical signal. Based on the difference between the fundamental frequency and an internal reference frequency, the microprocessor lights that one of the twelve LEDs which is closest to the unknown tone and blinks it at a rate proportional to the difference in the frequencies. Tuning direction is annunciated by causing the selected multi-colored LED to display a first color if flat, a different color if sharp, and yet another color if in tune. To function properly, this tuner must be stuck, by means of its adhesive pad, to the musical instrument.

Generally speaking, prior art tuning devices have appeared in a multitude of shapes and have had varying degrees of portability. Typically they have been either housed in stand-alone enclosures or, else, housed in enclosures which must be physically mounted to the musical instrument in order to function.

Despite their utility, the stand-alone acoustic tuning devices have been awkward to use. Characteristically, in order to acquire the musical tone with a sufficient signal-to-noise ratio, these tuners must be placed in near proximity to the musical instrument. As a result, the musician seeking to tune his instrument must place the tuner on a supporting surface such as a tabletop or music stand and hold his instrument dose to it.

The need to have a supporting surface nearby in order to prop up a tuner imposes a substantial limitation on a musician's freedom of movement. Even in performance, where a music stand may be available, a tuner placed on it can be accidentally knocked off and suffer damage, or it may obscure part of the music. Most problematic, however, is the difficulty the musician has when attempting to use such a tuner in the presence of ambient noise such as can exist during a performance. Often, to increase the amplitude of the musical tone over the ambient level, an acoustic guitarist will resort to removing the tuner from the stand and place it closer to the soundboard of his guitar by balancing it on his knee—an extremely clumsy operation. Also, in many situations, the performing musician chooses not to use a music stand. A classical guitarist, for example, usually performs a concert without written music in front of him, and the presence of a music stand or other tuner supporting surface would be unacceptable.

In an attempt to eliminate the above problems several tuning devices have appeared which require the mounting of the tuner onto the instrument. The Miller tuner, supra, is one such example. The need to stick this tuner to the instrument with a double back adhesive pad in order for it to function, however, imposes its own set of limitations. For example: the majority of concert level classical guitars are finished with a very thin, and very delicate, layer of French polish of shellac in order to ensure that the quality of the sound developed by the instrument is not compromised by its finish. Having invested many thousands of dollars, a classical guitarist is, invariably, unwilling to risk marring the instrument's surface and will not stick anything onto it. Also, the rectangular shape of this tuner does not readily permit it to be mounted to a number of other acoustic musical instruments, such as a trumpet.

SUMMARY OF THE INVENTION

The invention is summarized as a tuning device, for use in tuning an acoustic musical instrument, whose components—including sensing means operable for sensing an acoustic musical tone produced by the musical instrument and producing a representative electrical signal, conditioning means operable for amplifying, pre-filtering, and shaping the electrical signal into a representative pulse train, input means for selecting a musical note to tune to, computing means for receiving the pulse train and selected musical note and utilizing pre-programmed algorithms to determine the instrument's tuning condition, an output means to annunciate the tuning condition, and a power level switching means to permit the tuner to function in either a fully powered signal acquisition state or low power sleep state—are housed in a compact enclosure which mounts onto the wrist of the individual tuning the instrument, i.e., the musician.

Accordingly, one of the principal objects of the invention is an improved tuning device for use in tuning an acoustic musical instrument which, because it mounts onto the wrist of the musician, does not require the tuner to be placed on a supporting surface or be mounted to the instrument.

Another object of the invention is a tuning device which, by reason of its placement on the wrist of the musician, places the sensing means very near the instrument's sound source to provide a very high ratio of signal to noise. In the instance of an acoustic guitar, the sensing means, on average, is less than two inches from the soundboard.

Another object of the invention is a tuning device whose arrangement and orientation of components provides enhanced sensing of the acoustic musical tone, as well as simple ergonomic operation.

Another object of the invention is a tuning device which, by reason of its shape and method of construction, attaches quickly to the wrist and is unobtrusive and light in weight so that it may be easily worn by the musician for extended periods of time, for example, the duration of a concert.

Another object of the invention is a tuning device which is highly accurate and permits tuning to better than three cents.

Another object of the invention is a tuning device which operates to conserve battery power by automatically dropping, after a period of inactivity, into an extremely low power sleep mode.

Another object of the invention is a tuning device which can tune acoustic musical instruments, regardless of shape.

Further objects and advantages of the invention will be set forth in the following specification and in part will be obvious therefrom without being specifically referred to.

The invention accordingly comprises the features of construction, combination of elements and arrangement of parts which will be exemplified in a construction hereinafter set forth.

BRIEF DESCRIPTION OF THE DRAWINGS

It is understood that the following drawings are for the purpose of illustration and description, and are not intended as a definition of the limits of the invention.

DETAILED DESCRIPTION OF THE PREFERRED EMBODIMENT

Figure 1:
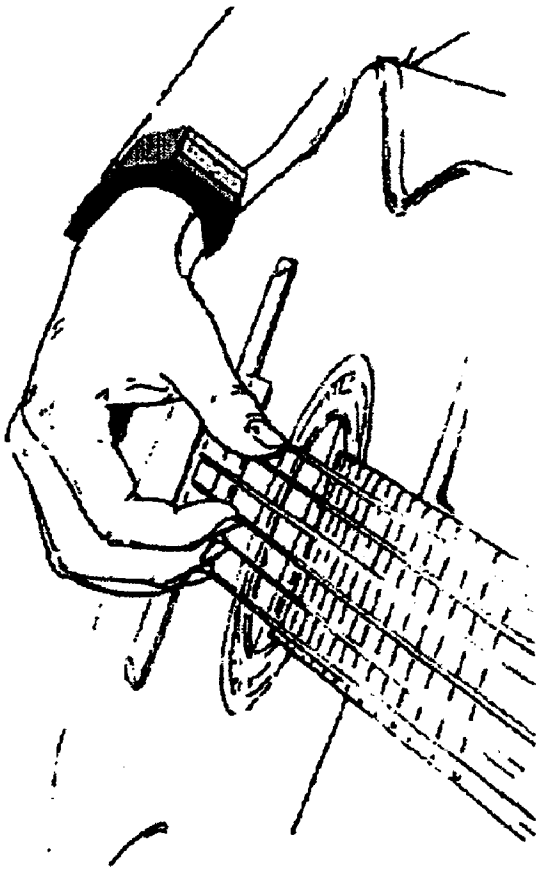
FIG. 1 is a partial perspective view of an electronic tuner constructed in accordance with the instant invention, wherein the invention is shown mounted to the wrist of a guitarist.

When tuning a musical instrument the instant tuner may be placed, in a manner hereinafter described, on either the left or right wrist of the musician. Additionally, as is shown in FIG. 1, if the musical instrument is, like a guitar or mandolin, normally cradled by the musician during play, then the tuner will necessarily always be within several inches of the instrument's soundboard. The parts of the preferred embodiment of the instant tuner are arranged to particularly exploit this playing position.

Figure 2:
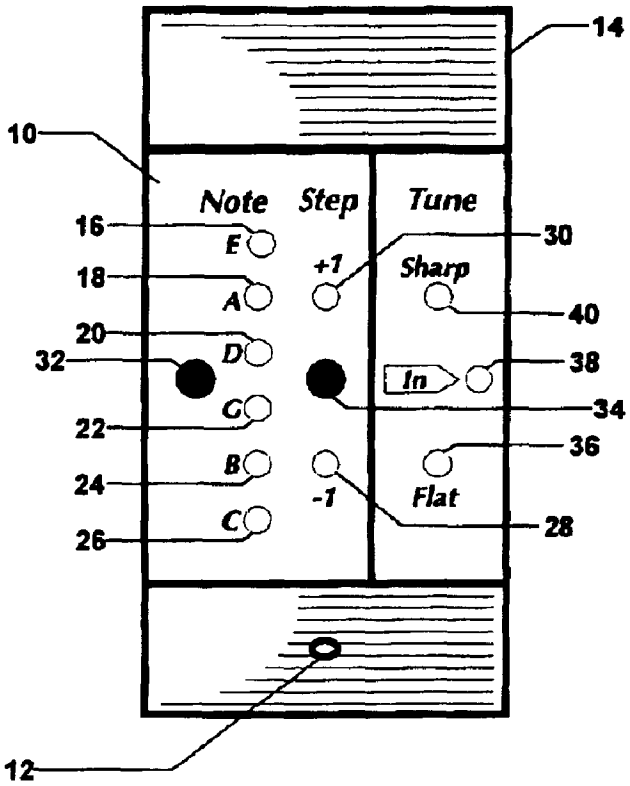
FIG. 2 is a front view of the invention of FIG. 1

Referring now to FIG. 2, there is shown a panel 10 which includes a plurality of light emitting diodes (LEDs) 16 through 30 and 36 through 40, momentary pushbuttons 32 and 34, and an open port 12, all of which are features of tuner casing 14. Port 12 is a through opening in casing 14 which permits external sound to reach the tuner's internal circuitry.

There are two operational states of the instant tuner: the acquisition state and the sleep state. During the acquisition state the tuner circuitry is fully powered on and, via port 12, is receptive to acoustic musical tones, i.e., acoustic signals having periodicity and with fundamental frequency components within the frequency range of musical instruments. More particularly, the circuitry is receptive to a range of frequencies centered around the fundamental frequency of the note annunciated by one of the Note LEDs 16 through 26 and Step LEDs 28 and 30. Notes indicated by LEDs 16 through 26 correspond to common reference notes found on the guitar—e.g., LEDs 16 through 24 correspond to the notes of the open strings in the "standard" tuning—as well as other instruments. Selecting, in order to tune to, one of the notes indicated by LEDs 16 through 26 is accomplished by repeatedly pressing momentary pushbutton 32—this action cyclically, and with rollover, advancing the LEDs—until the desired note is indicated. Departure from a reference note—in semitone steps—is accomplished by pressing momentary pushbutton 34 one, or more, times. Specifically, successively pressing pushbutton 34 cyclically steps the LEDs 28 and 30 in the following manner. If both LEDs 28 and 30 are off (not illuminated) pressing pushbutton 34 once will illuminate LED 28. This indicates that the tuner will tune one semitone lower than the reference note selected. For example, if note A was selected, the musical tone will now be tuned to Ab rather than A. Pressing pushbutton 34 a second time will turn LED 28 off and LED 30 on. This indicates that the tuner will tune one semitone higher than the reference note selected. For example, if note A was selected, the musical tone will now be tuned to A# rather than A. Pressing pushbutton 34 a third time will turn off both LEDs 28 and 30. This completes the cycle, and removes any semitone adjustment to the reference note. In this manner it is possible to tune to any of the twelve semitones across several octaves.

Proximity to the in-tune condition is displayed by LEDs 36 through 40. When the musical tone is within three cents of the frequency of the selected note LED 38 will illuminate solidly. If the musical tone is flat by more than three cents, LED 36 will blink at a rate proportional to the deviation and if the musical tone is sharp by more than three cents, LED 40 will blink, also at a rate proportional to the deviation.

To enable the tuner to conserve power and greatly extend battery life, whenever either pushbutton 32 or 34 is pressed a two minute timeout is set by the tuner circuitry, during which time the tuner will remain in its acquisition state. If, by the end of this interval, neither pushbutton is pressed, the tuner will enter an extremely low power sleep state in which it first saves the note selection settings and, then, shuts off all active circuitry except that which can detect the pressing of either pushbutton 32 or 34. Should, subsequently, either pushbutton be pressed the tuner will power up, recover the stored settings, illuminate the appropriate LEDs and, once again, enter the acquisition state. To further facilitate the tuning process all LEDs are preferably color coded. For example, LEDs 16 through 26 and LED 38 are preferably green, LEDs 28 and 36 are preferably yellow, and LEDs 30 and 40 are preferably red.

Figure 3:
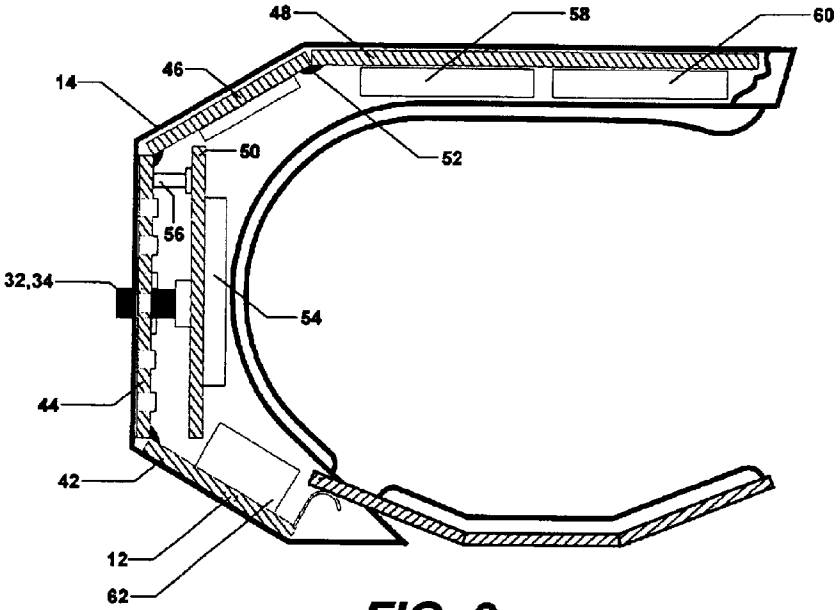
FIG. 3 is a cutaway side view of the invention of FIG. 1 showing the placement of components.

Turning now to FIG. 3, a cutaway side view of the instant tuner, it can be seen that the tuner circuitry, arranged on circuit boards 42 through 50, is distributed in such a manner as to generally conform to the shape of the wrist. Arranged circumferentially within casing 14, circuit boards 42 through 48 are made electrically continuous by solder fillets to a number of circuit board traces, here represented by fillet 52. Circuit board 50—upon which is mounted microcontroller 54, the principal tuner circuit element—receives power from interconnect 56. Electrical power is derived from replaceable coin type batteries 58 and 60.

Microphone 62, preferably an electret, is mounted to circuit board 42 and is positioned downward towards port 12 so that it is optimally receptive to external acoustic musical tones, especially from musical instruments such as an acoustic guitar.

Figure 4:
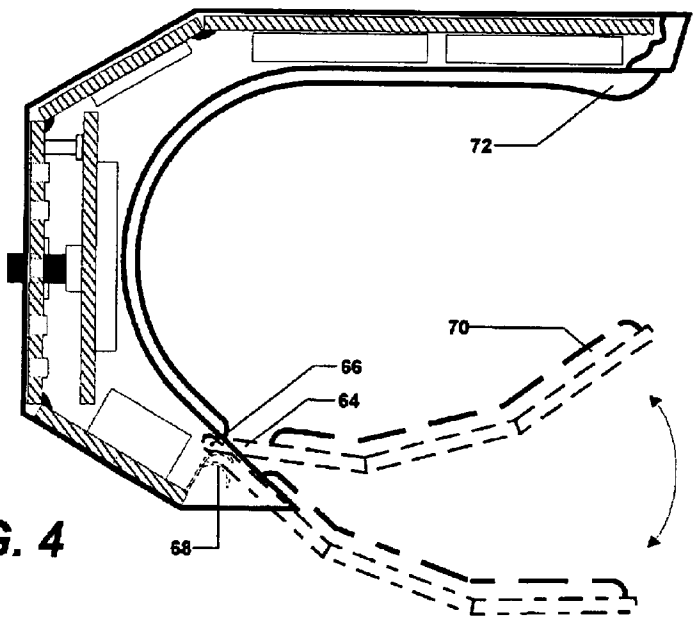
FIG. 4 is a cutaway side view of the invention showing the manner in which it adapts to a range of wrist sizes.

A wide range of wrist sizes can be accommodated by the self-adapting wristband mechanism shown in FIG. 4. The tuner is gently held onto the wrist by means of light pressure provided by spring loaded band 64, here shown in two accommodating positions. Pivoting around pin 66 band 64 receives a restoring force from spring 68, the shape of which provides uniform pressure on the wrist irrespective of band angular position. The addition of conformal soft foam pads 70 and 72 provide further wearing comfort.

Figure 5:
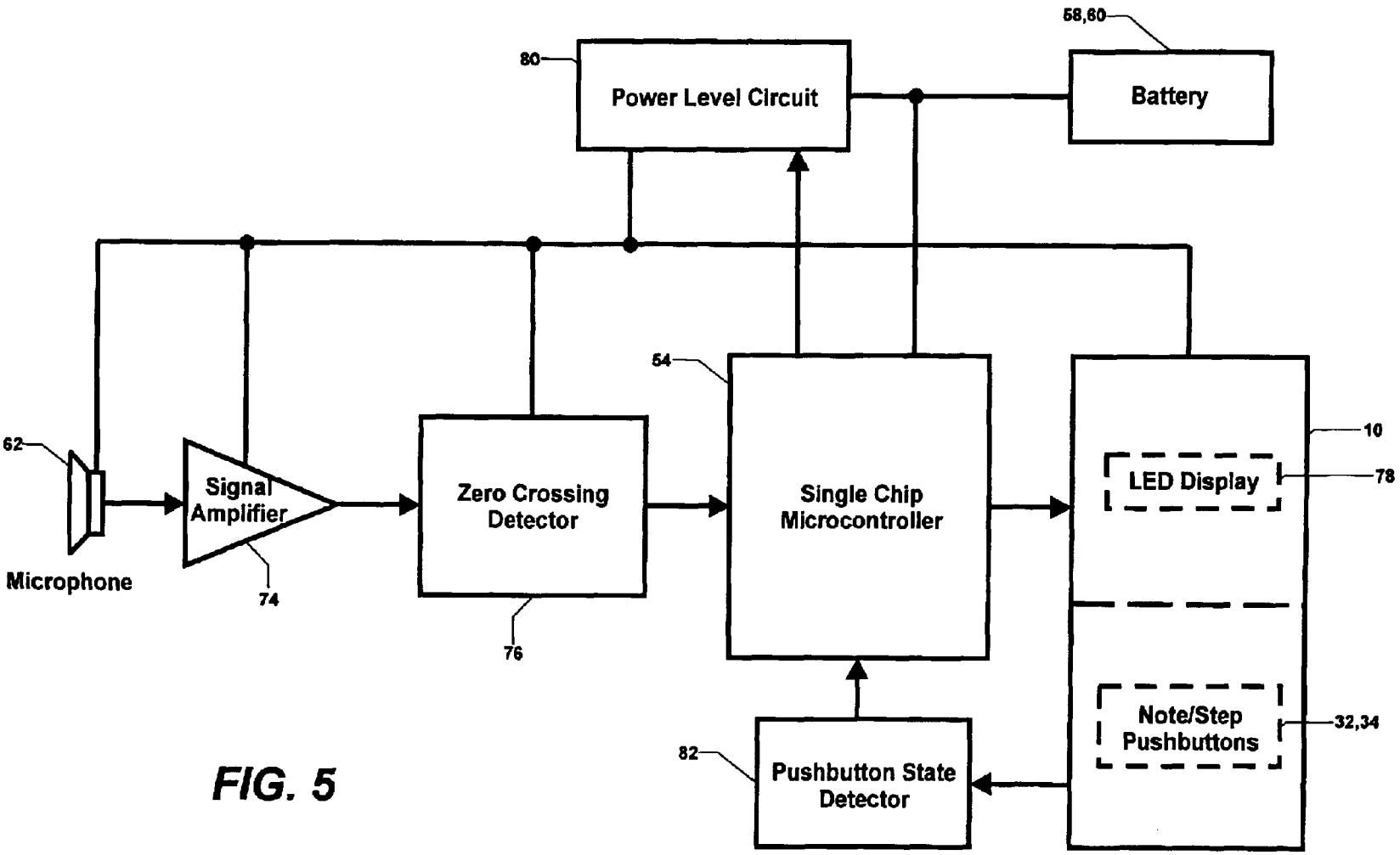
FIG. 5 is a block diagram of the electronic circuit of the invention.

As shown in FIG. 5 the electronic circuit components of the tuner are interconnected, and function, as follows. The acoustic musical tone is received, as described above, by the microphone 62, and it generates a representative electrical signal which is amplified by signal amplifier 74, detected by zero crossing detector 76 and, by employment of a series of pre-programmed qualification algorithms, analyzed by microcontroller 54. These algorithms determine the fundamental frequency component of the musical tone and, also, function to disregard signals which do not have periodicity within the frequency range of musical instruments.

Depending upon the settings of pushbutttons 32 and 34 microcontroller 54 acts, in the above described manner, to illuminate the LEDs in the LED display 78, part of panel 10. When the tuner is in the acquisition state microcontroller 54 enables the power level circuit 80 which, in turn, gates power from battery 58 and 60 to microphone 62, signal amplifier 74. zero crossing detector 76, and panel 10. When the tuner enters the sleep state microcontroller 54 disables the power level circuit 80 which, in turn, removes power from all of the circuitry except microcontroller 54. Once this action is performed, microcontroller 54, itself, enters a very low power consumption state in which all of its internal circuitry is powered off except that which is responsive to any state changes in pushbuttons 32 and 34 detected by the passive components in the pushbutton state detector 82.

In a general manner, while the invention has been disclosed with reference to a particular preferred embodiment, it is to be understood that the invention is not limited to such embodiment as various modifications may be made in the construction thereof without departing from the scope and spirit of the invention.

What is claimed is:

1. A tuning device for use in tuning an acoustic musical instrument, comprising:

a housing;

sensing means operable for sensing a tone emitted by the musical instrument and producing a representative electrical signal;

conditioning means operable for amplifying, pre-filtering, and shaping said representative electrical signal into a representative pulse train;

input means operable for selecting at least one of the twelve standard notes in a musical octave to form a comparison standard for tuning;

computing means operable for computing the fundamental frequency of the first harmonic in said representative pulse train, and computing the difference, and difference direction, whether plus or minus, between said fundamental frequency and each of the note frequencies in said comparison standard to calculate the least difference and least difference direction;

output means operable for displaying said comparison standard and said least difference and least difference direction;

said sensing means, said conditioning means, said input means, said computing means, and said output means collectively enclosed within said housing; and mounting means operable for permitting said housing to be affixed to the wrist, the mounting means including a generally C-shaped frame fitted with opposing members, at least one of the members being arcuate and mounted for movement toward the other, and operable, by urging said C-shaped frame onto the wrist at its open end, to slide onto, surround, and grip the wrist;

whereby said tuning device, by reason of its placement on the wrist, is necessarily placed in close proximity to the sound source of a wide range of musical instruments and, thereby, enables tuning with a high signal to noise ratio; and whereby said tuning device, during use, does not require attachment to the musical instrument nor a separate supporting surface.

2. The tuning device of claim 1 wherein said C-shaped frame is generally shaped to conform to the contour of the human wrist.

3. The tuning device of claim 1 wherein said sensing means is a microphone disposed within said housing so as to generally face the sound source of the musical instrument.

4. The tuning device of claim 1 wherein said input means includes a first pushbutton and a second pushbutton used, in combination, for selecting exactly one of the twelve standard notes in a musical octave to form said comparison standard;

said first pushbutton operable to select one of the standard notes E, A, D, G, B, C by repeatedly pressing it to advance to the desired note;

said second pushbutton operable to alter, by repeatedly pressing it, the selected said one of the twelve standard notes by raising it one semitone on the first press, lowering it one semitone on the second press, and removing any alteration on the third press; and said output means includes a first plurality of eight light emitting diodes to display said comparison standard, consisting of:

six light emitting diodes arranged in a column to display said standard notes E, A, D, G, B, C, the illumination of one of which indicates the selected said one of the standard notes; and a +1 step light emitting diode to display the altered state of the selected said one of the standard notes raised one semitone; and a −1 step light emitting diode to display the altered state of the selected said one of the standard notes lowered one semitone; and a second plurality of three light emitting diodes approximately arranged in a column to display said least difference and least difference direction, consisting of:

a sharp light emitting diode located at the uppermost column position and operable to illuminate when said least difference is both positive and greater than three cents, and blink at a rate proportional to the magnitude of said least difference;

an in tune light emitting diode located at the center column position and operable to illuminate when said least difference is less than, or equal to, three cents, and blink at a rate proportional to the magnitude of said least difference;

a flat light emitting diode located at the bottommost column position and operable to illuminate when said least difference is both negative and greater than three cents, and blink at a rate proportional to the magnitude of said least difference.

5. The tuning device of claim 1 wherein said input means includes a pushbutton for selecting exactly twelve of the twelve standard notes in a musical octave to form said comparison standard; said pushbutton operable to select all of the standard notes A, A#, B, C, C#, D, D#, E, F, F#, G, G#; and said output means includes a first plurality of twelve light emitting diodes to display said comparison standard and is operable to illuminate that one of said twelve light emitting diodes which corresponds to that note in said comparison standard whose corresponding frequency subtracted from said fundamental frequency is said least difference; and a second plurality of three light emitting diodes approximately arranged in a column to display said least difference and least difference direction, consisting of:

a sharp light emitting diode located at the uppermost column position and operable to illuminate when said least difference is both positive and greater than three cents, and blink at a rate proportional to the magnitude of said least difference;

an in tune light emitting diode located at the center column position and operable to illuminate when said least difference is less than, or equal to, three cents, and blink at a rate proportional to the magnitude of said least difference;

a flat light emitting diode located at the bottommost column position and operable to illuminate when said least difference is both negative and greater than three cents, and blink at a rate proportional to the magnitude of said least difference.

6. The tuning device of claim 1 wherein at least one of said opposing members of said C-shaped frame is springably articulated for resiliently urging said opposing member against the wrist.

7. The tuning device of claim 1 wherein both of said opposing members of said C-shaped frame are springably articulated for resiliently urging said opposing members against the wrist.

8. The tuning device of claim 1 wherein at least one of said opposing members of said C-shaped frame is rotatably attached by a friction hinge.

9. The tuning devise of claim 1 wherein both of said opposing members of said C-shaped frame are rotatably attached by friction hinges.

* * * * *